US009011134B2

(12) United States Patent
Weinhold et al.

(10) Patent No.: US 9,011,134 B2
(45) Date of Patent: Apr. 21, 2015

(54) METHOD AND APPARATUS FOR FIBRILLATING SYNTHETIC RIBBONS

(71) Applicant: Oerlikon Textile GmbH & Co. KG, Remscheid (DE)

(72) Inventors: Jens Weinhold, Chemnitz (DE); Bert Wöllner, Hohenstein-Ernstthal (DE); Marko Neubert, Jöhstadt/OT Grumbach (DE); Uwe Hirsch, Flöha (DE)

(73) Assignee: Oerlikon Textile GmbH & Co., KG, Remscheid (DE)

( * ) Notice: Subject to any disclaimer, the term of this patent is extended or adjusted under 35 U.S.C. 154(b) by 146 days.

(21) Appl. No.: 13/663,632

(22) Filed: Oct. 30, 2012

(65) Prior Publication Data

US 2013/0055536 A1 Mar. 7, 2013

Related U.S. Application Data

(63) Continuation-in-part of application No. PCT/EP2011/056935, filed on May 2, 2011.

(30) Foreign Application Priority Data

May 3, 2010 (DE) ..... 10 2010 019 144

(51) Int. Cl.
*B26D 1/28* (2006.01)
*D01D 5/42* (2006.01)
*D01G 19/10* (2006.01)

(52) U.S. Cl.
CPC ..... *D01D 5/423* (2013.01); *D01G 19/105* (2013.01)

(58) Field of Classification Search
CPC ..... B26D 1/285; B26D 7/08; D01D 5/423
USPC ..... 425/336
See application file for complete search history.

(56) References Cited

U.S. PATENT DOCUMENTS 3,536,238 A 10/1970 Iwama et al.
3,646,639 A 3/1972 Burckhardt et al.
4,017,251 A * 4/1977 Coburn et al. ..... 425/404
4,065,538 A 12/1977 Gustafson et al.

(Continued)

FOREIGN PATENT DOCUMENTS

DE 1907 007 A1 8/1970
DE 19645696 11/1997

(Continued)

OTHER PUBLICATIONS

PCT/EP2011/056935 International Preliminary Report on Patentability dated Nov. 6, 2012 (7 pages).

*Primary Examiner* — Alison Hindenlang
(74) *Attorney, Agent, or Firm* — Brinks Gilson & Lione; G. Peter Nichols

(57) ABSTRACT

The invention relates to a method and apparatus for fibrillating synthetic ribbons in an extrusion process for the production of, for example, grass fibers. The extrusion process creates a sheet of ribbons from an extruded foil or a multiplicity of extruded monofils, and stretches them conjointly. The ribbons are led side by side in a parallel arrangement along the circumference of a fibrillating roll with a partial wrap. To produce a pattern of fibrillation irrespective of the thickness of the ribbons and the elasticity of the ribbons, the invention provides that a multiplicity of short partial cuts is made in the ribbons by a plurality of successively engaging rows of blades on the fibrillating roll each having a multiplicity of projecting cutting tips.

16 Claims, 6 Drawing Sheets

(56) References Cited

U.S. PATENT DOCUMENTS 6,439,498 B1 * 8/2002 Hufschmidt et al. ..... 242/471

FOREIGN PATENT DOCUMENTS

| | | |
|---|---|---|
| EP | 0 003 490 | 8/1979 |
| EP | 0 358 334 | 8/1989 |
| GB | 1214543 | 12/1970 |
| GB | 1358987 | 7/1974 |
| GB | 2011 966 | 7/1979 |
| JP | 4144882 | 5/1992 |
| WO | WO 2010/112300 | 10/2010 |
| WO | WO 2011/138261 | 11/2011 |

* cited by examiner

METHOD AND APPARATUS FOR FIBRILLATING SYNTHETIC RIBBONS

This application is a continuation-in-part of and claims the benefit of priority from PCT application PCT/EP2011/056935 filed May 2, 2011 and German Patent Application DE 10 2010 019 144.2 filed May 3, 2010, the disclosure of each is hereby incorporated by reference in its entirety.

The invention relates to an apparatus and method for fibrillating synthetic ribbons in an extrusion process to produce, for example, glass fibers.

BACKGROUND

Methods and apparatuses of this type, for fibrillating synthetic ribbons or synthetic films, which are first extruded from a thermoplastic material, are known in general and are used for the structuring of ribbons or films. In doing so, it is possible to design, in particular, the smooth surfaces of the ribbons or films with a longitudinally executed structure. A method of this type and an apparatus of this type are known, for example, from EP 0 003 490.

With the known method and with the known apparatus a film is extruded from a thermoplastic material in an extrusion process, and a multiplicity of ribbons is cut therefrom. After stretching, the ribbons are fibrillated.

The fibrillation is normally carried out through spiked rollers, as are known, for example, from EP 0 358 334. A plurality of pins are attached such that they extend outward from the circumference of the spiked rollers, such that the pins, when the ribbons are fed onto the spiked roller, penetrate the ribbons, and generate a longitudinal slit in the ribbons, depending on the wrapping of the ribbons on the spiked roller. Particular fibrillation structures can be cut in the ribbons by means of the number and offsetting of the pins on the circumference of the spiked roller.

With the known method and with the known apparatus it has been found that with an increasing thickness of the ribbons, an undesired increase in the tractive forces occurs, in order to enable the penetration and cutting of the ribbons. In extreme cases, the ribbons are simply pushed away from the pins, without the pins penetrating the ribbons. In particular with the production of grass fibers, increasingly, synthetic ribbons made of numerous material components are formed, such that different layer thicknesses having corresponding thicknesses of the overall layer are obtained. With multi-layer ribbons of this type, it has furthermore been established that imprecisely cut edges are formed, which result in a significant loss in the strength of the ribbons.

SUMMARY

It is therefore the objective of the invention to provide a method and an apparatus for the fibrillation of synthetic ribbons of the generic type, with which thicker ribbons can also be securely fibrillated and without loss to the strength thereof.

A further aim of the invention is to create a method and an apparatus for the fibrillation of a bundle of ribbons with which a uniform fibrillation structure can be generated on the ribbons.

This objective is attained by means of a method, in which the cutting of numerous short partial cuts is generated on the ribbons by means of numerous successively engaging rows of blades on the fibrillation roller, each having numerous projecting cutting tips.

The apparatus according to the invention attains the objective in that the fibrillation roller has numerous blade strips distributed uniformly on the circumference, and that on each blade strip there are numerous cutting tips disposed on a rows of blades, with extending cutting edges disposed thereon.

Advantageous further developments of the invention are defined by the characteristics and the combinations of characteristics of the respective dependent claims.

The invention has the particular advantage that the fibrillation structure in the ribbons is generated exclusively by means of slicing. In this manner it is possible to generate the fibrillation structure solely by means of a relative speed adjustment between the fibrillation roller and the ribbons, without a resulting greater penetration resistance. In addition, clean cuts are generated, having no fraying.

For the production of web shaped fibrillation structures in the ribbons, the method provides generating at least two groups of short partial cuts on the ribbons by means of offset cutting tips of two successively engaging rows of blades.

The apparatus according to the invention is designed for this in such a manner that the neighboring rows of blades on the circumference of the fibrillation roller are attached such that on the relevant blade strips their cutting tips are offset to one another. The distribution of the partial cuts in the ribbons can be affected thereby both by means of the spacing of the blade strips on the circumference of the fibrillation roller as well as by means of the spacing of the cutting tips in relation to each other.

In one embodiment of the present method, after stretching, the ribbons within the ribbon bundle may be guided in a manner spaced from one another such that the partial cuts are generated substantially symmetrical, in particular in relation to the edge regions of the ribbons. As such, the ribbons, prior to and/or after the fibrillation are calibrated individually or in groups, in such a manner that the partial cuts are generated substantially symmetrically on each ribbon, having a minimum spacing to the edges of the ribbons. A calibration of this type, of the ribbons in relation to the configuration of the rows of blades, also enables an extremely uniform fibrillation, such that, substantially, all ribbons in the ribbon bundle have a uniform fibrillation structure.

The apparatus according to the invention has, advantageously, an adjustment device for this purpose, dedicated to the fibrillation roller, and the means for adjusting the individual or numerous ribbons in relation to the position of the cutting tips on the circumference of the fibrillation roller. In this manner, the exact guidance of the ribbons can be ensured.

As a result of the stretching of the ribbons as a bundle of ribbons, greater or lesser spacings between neighboring ribbons is obtained, such that the adjustment occurs preferably with the further development of the invention in which the means are formed as a result of adjustable guidance pins or guidance rollers disposed between the ribbons. For this, the guidance pins or guidance rollers can be adjusted in groups or individually.

Due to the limited penetration resistance of the cutting tips into the material of the ribbons, it has been shown that even limited relative speeds between the circumferential speed of the fibrillation roller and the feed rate of the ribbons are sufficient for generating the fibrillation structure. As such, an alternative the method for generating the partial cuts in the ribbons may include driving the fibrillation roller at a circumferential speed that is faster than a feed rate of the ribbons.

For this, a controllable drive is dedicated to the fibrillation roller, which is connected to a machine control unit for setting predetermined circumferential speeds of the fibrillation roller. For this, predetermined process parameters, such as the stretching ratio, for example, may be used directly in the production of the ribbons, in order to set a predetermined circumferential speed of the fibrillation roller attuned to the respective process and the respective material of the ribbons.

In particular with the production of grass fibers it has been found that very adhesive and elastic materials are used, which are particularly delicate. In order to act against the friction occurring as a result of the relative speed between the fibrillation roller and the ribbons, the ribbons are advantageously guided over a friction reducing contact surface between the rows of blades in a partial wrapping on the circumference of the fibrillation roller.

The apparatus according to the invention, for this purpose, provides for the particularly preferred further development of the invention in which the fibrillation roller has a friction reducing contact surface in each of the regions between the rows of blades on its circumferences.

In order, on the one hand, to ensure limited frictional values, and on the other hand to prevent a premature wearing out of the fibrillation roller, the further development of the invention in which the contact surfaces have a multiple coating of numerous coating materials, which are formed from numerous sandwich-like individual coatings, is particularly suited for this.

Preferably, in this case, the coating material of the outermost individual coating is formed by a low-friction material for the reduction of the friction and the coating material of the inner individual coatings is formed by a protective substance for reducing the wear.

As a low-friction material, plastics, in particular PTFE are used, and for the protective material, a ceramic is preferably used. By this means, very long operational times and particularly protective ribbon feeds can be executed on the fibrillation roller.

The method according to the invention, as well as the apparatus according to the invention are suited in particular for the fibrillation of the ribbons that are relatively thick and that have a relatively large material expansion after the stretching. In this respect, the method variation for the production of grass fibers is preferably used, in which the ribbons, after stretching, have a thickness in the range of 150 μm-500 μm, and/or a material expansion of in the range of 50%-75%. Partial cuts are securely generated even with the thickest and most elastic of ribbons by means of the cutting tips and blade edges.

The method according to the invention as well as the apparatus according to the invention shall be explained in greater detail below, based on exemplary embodiments of the apparatus according to the invention.

DETAILED DESCRIPTION

Figure 1:
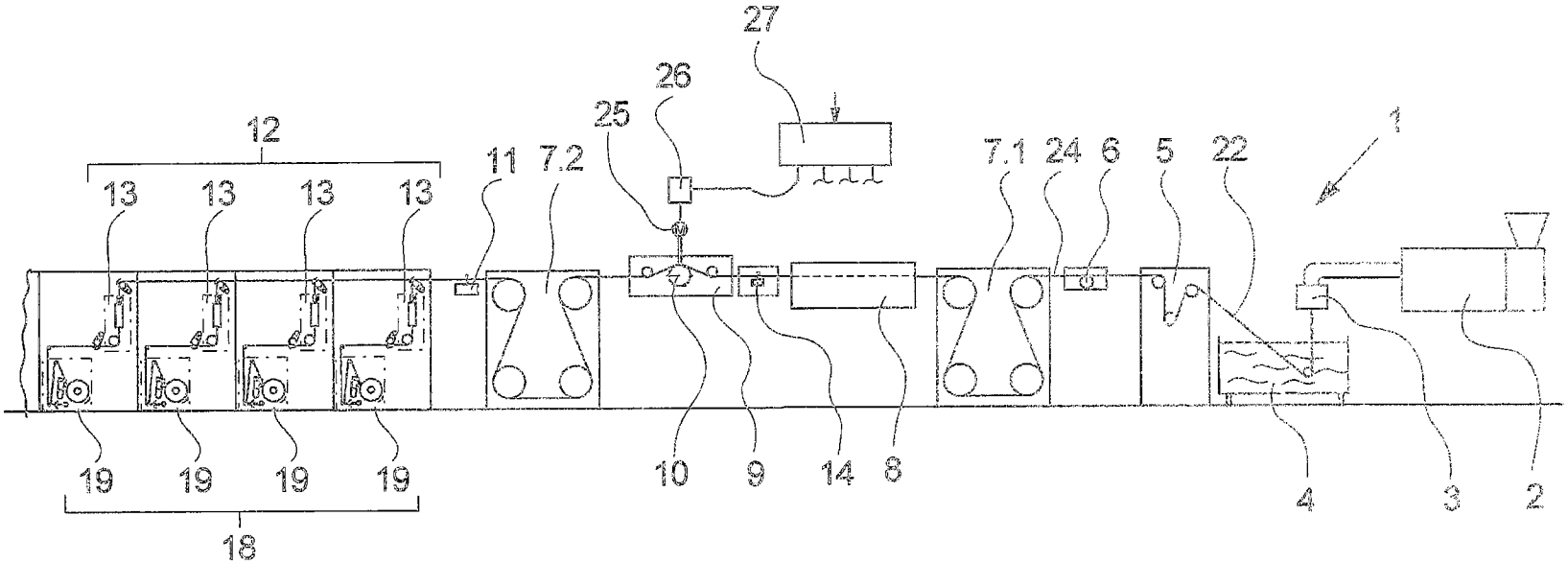
FIG. 1 depicts schematically, a view of a first embodiment example of the apparatus according to the invention for the execution of the method according to the invention.
Figure 2:
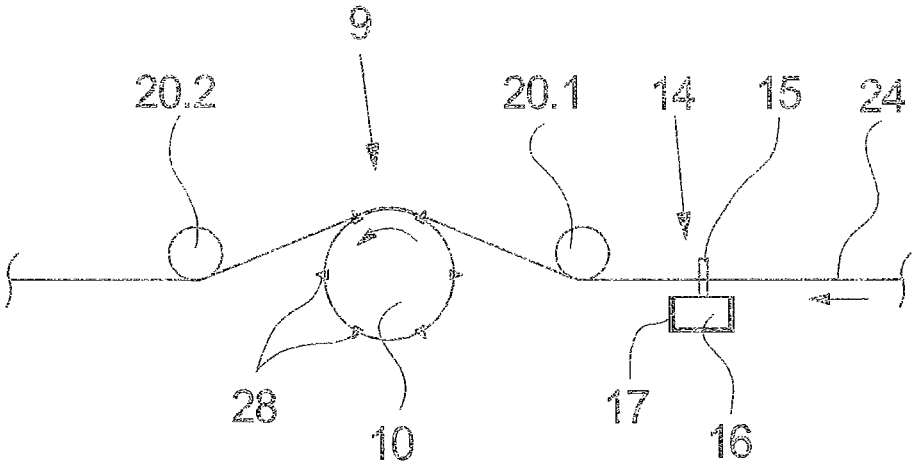
FIG. 2 depicts schematically, a cross-section of a detail of the embodiment example from FIG. 1.
Figure 3:
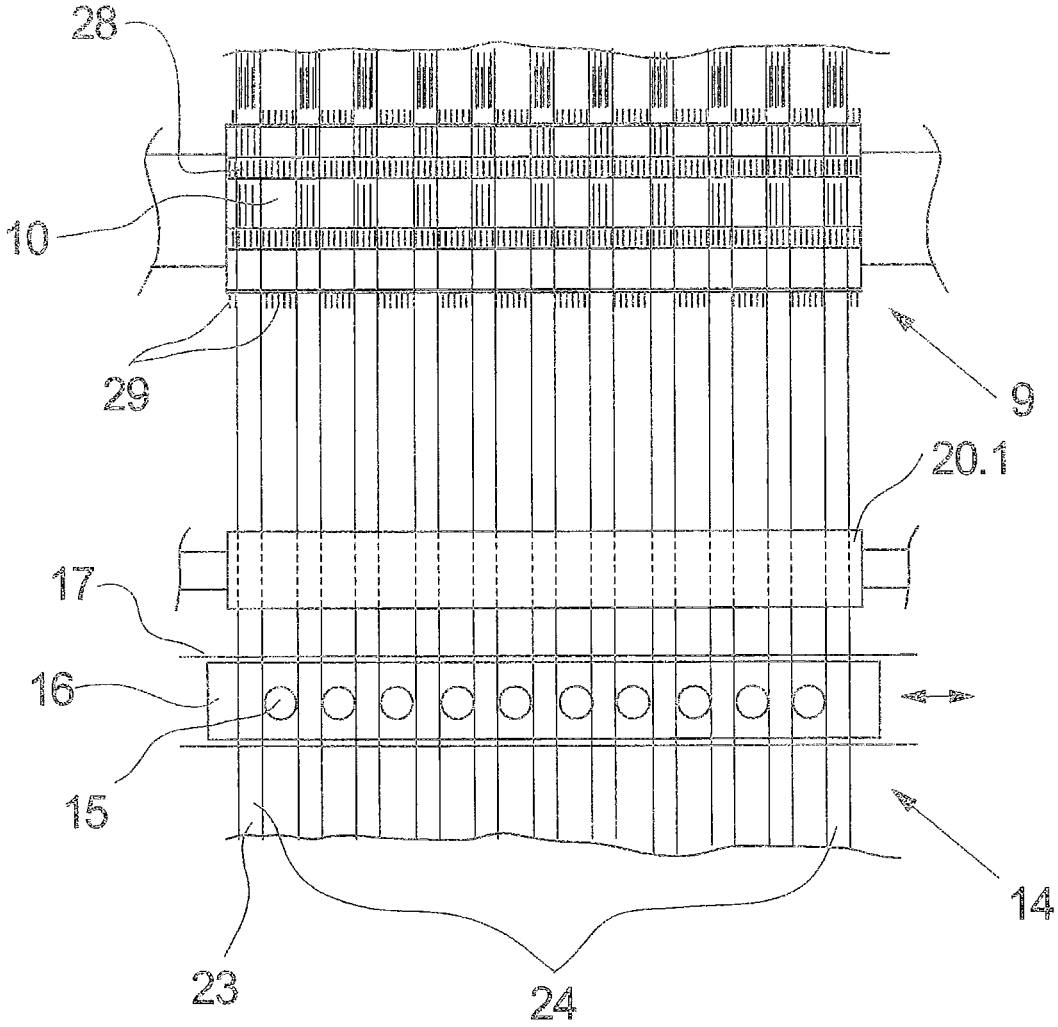
FIG. 3 depicts schematically, a detail of a top view of the embodiment example from FIG. 1.

An embodiment of the apparatus for the execution of the method according to the invention for the fibrillation of a bundle of ribbons from an extrusion procedure is schematically depicted in FIGS. 1-3. The embodiment example is depicted in full in FIG. 1, it is shown in a detail from the side in the region of the fibrillation in FIG. 2, and a top view of a detail is shown in FIG. 3. The following description applies to all figures, insofar as no specific reference to one of the figures is made.

The embodiment of the apparatus according to the invention is shown in full in FIG. 1. The embodiment has an extrusion apparatus 1, for generating a film from a thermoplastic material. In this example, the extrusion apparatus 1 has an extruder 2. The extruder 2 is connected to an extrusion die 3, which extrudes a flat film 22 from a thermoplastic material melted by the extruder 2.

At this point is should be noted that the extrusion apparatus 1 can also have two extruders, in order to extrude a two-color flat film or a flat film having different polymer materials.

A cooling bath 4 is associated with the extrusion die 3. A redirection device 5 is provided at the discharge end of the cooling bath 4, for the purpose of removing residual moisture adhering to the film 22 by means of redirection and suction. For this, the redirection device 5 is typically combined with a suction device, which draws off the adhering cooling fluid from the cooling bath 4.

In order to cut the film 22 generated in the extrusion apparatus into a bundle of ribbons 24, a cutting device 6 is located downstream of the redirection device 5. In the cutting device 6, the film 22 is cut into numerous individual ribbons 23 having a predetermined width.

To extract the film 22, or the ribbon bundle 24, and to stretch the ribbons 24, a number of godet delivery devices 7.1 and 7.2 propelling godets are successively provided. The ribbons 23 are guided, adjacent and parallel to one another, with a simple wrapping about the exterior of the godets fed thereto from the godet delivery devices 7.1 and 7.2.

A heating device 8 is disposed between the godet delivery devices 7.1 and 7.2. The heating device 8 may, for example, take the form of a convection oven, in which the ribbons are heated to a stretching temperature. For the stretching of the ribbons, the godets from the godet delivery device 7.1 and 7.2 are propelled at different rates.

A fibrillation device 9 is disposed between the heating device 8 and the second godet delivery device 7.2. The fibrillation device 9 has a fibrillation roller 10, the circumference of which the ribbons 23 are fed with a partial wrap for the purpose of fibrillation. The fibrillation roller 10 is driven by means of an electric motor 25, controlled by means of the control device 26. The control device 26 is coupled to a machine control 27, such that depending on the production speed of the ribbons, defined by the godet propulsion, a specific circumferential speed of the fibrillation roller 10 can be set. In this manner, it is possible to drive the fibrillation roller 10 at a circumferential speed for the purpose of fibrillation, which is preferably higher than the production speed of the ribbons 23.

For further explanation of the fibrillation device 9, additional reference is made to FIGS. 2 and 3. FIG. 2 shows a detail of the side view of the fibrillation device 9, and FIG. 3 shows a detail of the top view of the fibrillation device 9.

The fibrillation roller 10 has numerous blade strips 28 distributed uniformly on the circumference thereof, each having numerous projecting cutting tips 29. Each cutting tip 29 contains a blade, oriented toward the rotational direction of the fibrillation roller 10. The cutting tips shall be explained in greater detail below.

At the intake end of the ribbons 24, an adjustment device 14 is associated with the fibrillation roller 10. The adjustment device 14 has a plurality of substantially vertical guide pins 15, which are held on a carrier 16. The guide pins 15, which can alternatively be formed as freely turning guide rollers on vertical axes, each extend between two adjacent ribbons 23 of the ribbon bundle 24. The guide pins 15 have dimensions in their outer diameter such that the ribbons 23 are fed without any substantial tolerance between two adjacent pins 15. The carrier 16 supporting the guide pins 15 is retained in a guide track 17 and can be displaced within the guide track 17 at a right angle to the running direction of the ribbons 23. By displacing the carrier 16, the ribbons 23 of the ribbon bundle 24 can be adjusted in relation to the position of the cutting tips 29 on the circumference of the fibrillation roller 10. In particular, it is possible to implement symmetrical cuts by means of the cutting tips 29 in the ribbons 23. In particular, minimum spacings at the edge regions can be ensured in the ribbons by this means.

In order to obtain a defined wrapping of the ribbon bundle 24 on the circumference of the fibrillation roller 10, two guide rollers 20.1 and 20.2 are provided to guide the intake and uptake of the ribbon bundle 24.

After the fibrillation and stretching, the ribbons 23 are fed to a crimping device 12 and a coiling device 18. The crimping device 12, as well as the coiling device 18 has numerous texturing means 13 and coiling stations 19, for texturing the ribbons individually or collectively, and for coiling them on spools. For this, it is possible to consolidate the ribbon bundle 24 individually or in groups by means of a guide rail 11.

With the exemplary embodiment depicted in FIGS. 1-3, a grass yarn is produced which can already be processed in a further processing procedure to form, directly, an artificial turf.

Figure 4:
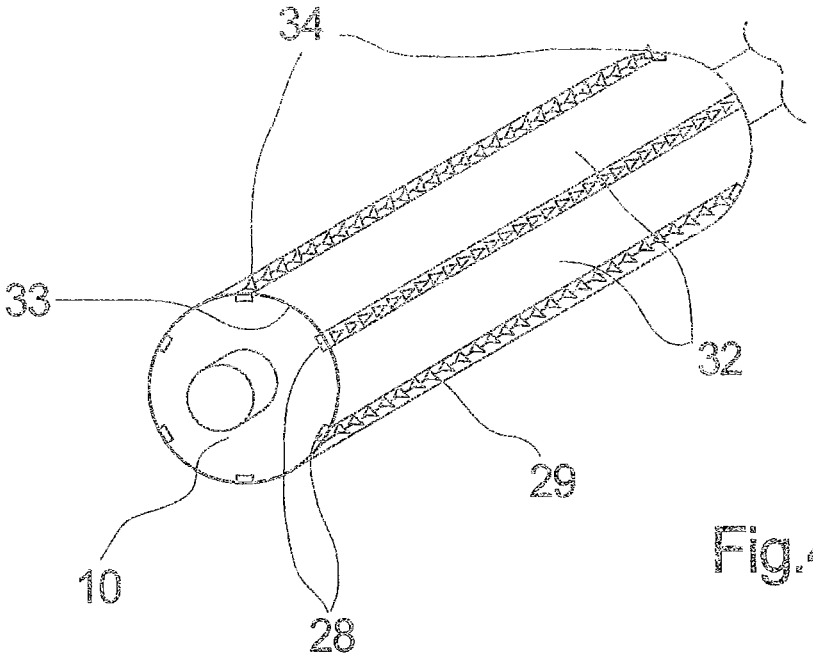
FIG. 4 depicts schematically, a view of the fibrillation roller.
Figure 5:
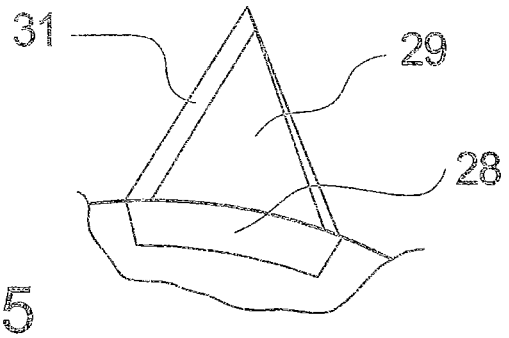
FIG. 5 depicts schematically, a view of a cutting tip of the fibrillation roller in FIG. 4.

An exemplary embodiment of a fibrillation roller 10 is depicted in FIG. 4. The fibrillation roller 10 has numerous blade strips 28 which are disposed uniformly on the circumference of the fibrillation roller 10. The blade strips 28 are equipped with numerous cutting tips 29, which are held in an extending manner as a row of blades 34, spaced from one another. Each of the cutting tips 29 contains a blade 31, oriented toward the turning direction of the fibrillation roller 10. By way of example, a view of one of the cutting tips 29 is depicted in FIG. 5. The cutting tips 29 are retained on the blade strips 28, whereby the blade strip 28 is disposed in a groove in the fibrillation roller. The cutting tip 29 has a triangular shape, with a projecting tip. The blade 31 is ground to form a blade on one side of the cutting tip 29, extending to the tip. The blade 31 is oriented toward the turning direction of the fibrillation roller 10, such that when the fibrillation roller rotates, it penetrates a ribbon and generates a finite partial cut, depending on the wrapping of the ribbon.

The configuration of the cutting tips 29 and the blade strips 28 can be selected in such a manner that different fibrillation patterns result. As such, parallel configurations of cutting tips, and offset configurations of cutting tips, are possible.

Turning to FIG. 4, it is seen that numerous contact surfaces 32 are formed on the circumference of the fibrillation rollers 10. The contact surfaces 32 of the fibrillation rollers 10 extending between the blade strips 28 have a multiple coating 33. In order to enable guidance of the ribbons 23 over the contact surfaces 32 that is low-friction and durable to the greatest extent possible, the multiple coating 33 is preferably formed by an inner single coating and an outer single coating, which are disposed on top of one another in the manner of a sandwich. The inner single coating is applied directly on a base material of the fibrillation roller 10. An outer single coating lies above the inner single coating, the thickness of which may be the same or different from that of the first single coating. The outer single coating has a low-friction material as the coating material, such that the guide surface of the fibrillation roller 10 directly facing the ribbons is determined by the material characteristics of the low-friction material. The coating material of the inner single coating is formed, however, by a protective coating, which provides a wear protection coating for the base material of the fibrillation roller. As such, a ceramic is preferred for the protective material. Ceramics of this type can be applied, for example, in the form of a plasma coating. The border surface of the inner single coating to the outer single coating preferably has a rough structure, such that in the operational status, after the low-friction material in the outer coating has been worn down, a mixed surface is obtained, formed in part by the low-friction material, and in part by the protective material. A guide surface of this type has the particular advantage that the ribbons 23 can be guided with a low degree of friction and in a manner that is resistant to wear. Plastic is typically used for the low-friction material and PTFE plastic (Teflon) has been determined to be particularly advantageous, in particular, for the guidance of ribbons 23. In this respect, the ribbons can be fed with slippage about the circumference of the fibrillation roller 10.

Figure 6:
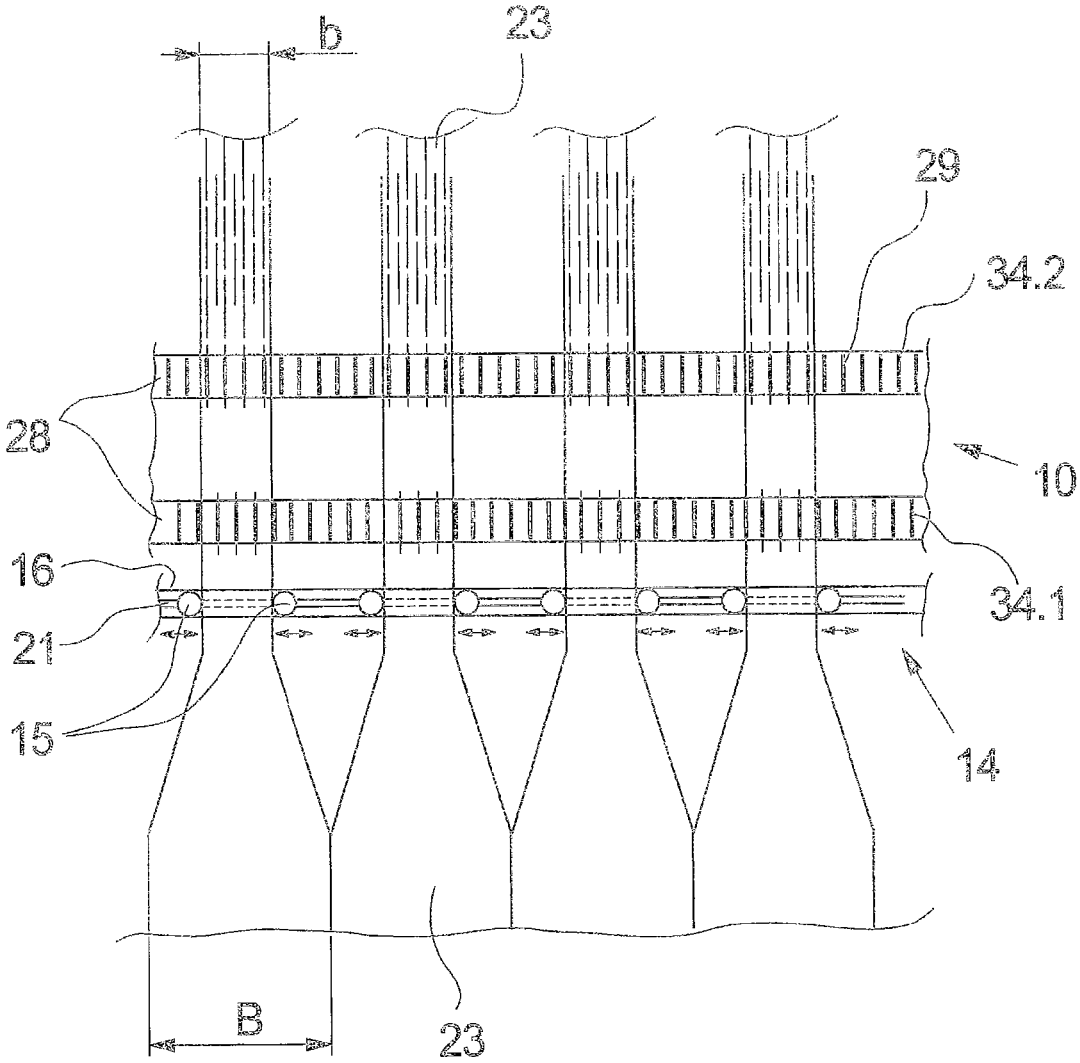
FIG. 6 depicts schematically, a detail of a top view of another embodiment of the apparatus according to the invention for the execution of the method according to the invention.

In order to be able to securely fibrillate highly stretched ribbons in the production of grass fibers, another exemplary embodiment of a fibrillation apparatus is shown in FIG. 6, which could be used for example in the extrusion process depicted in FIG. 1. For this, a schematic detail of the top view is shown in FIG. 6. In this case, only the components relevant to the fibrillation of the ribbons are shown.

The fibrillation roller 10 is structured identically to the exemplary example according to FIG. 4, wherein, for the generation of the partial cuts in the ribbons 23, in each case two rows of blades 34.1 and 34.2 are successively engaged, and in part simultaneously. The cutting tips 29 on the first rows of blades 34.1 are axially displaced in relation to the cutting tips 29 on the second rows of blades 34.2. In this manner, two respective groups of partial cuts are generated in the ribbons 23.

The adjustment device 14 is associated with the fibrillation roller 10 at the intake end. The adjustment device 14 is formed by numerous guide pins 15, which are retained in a displaceable manner in a guide groove 21 of a carrier 16. For this, two laterally displaceable pins 15 are associated with each ribbon 23. The pins 15 are substantially vertical and form a lateral border to the ribbons 23.

Figure 7:
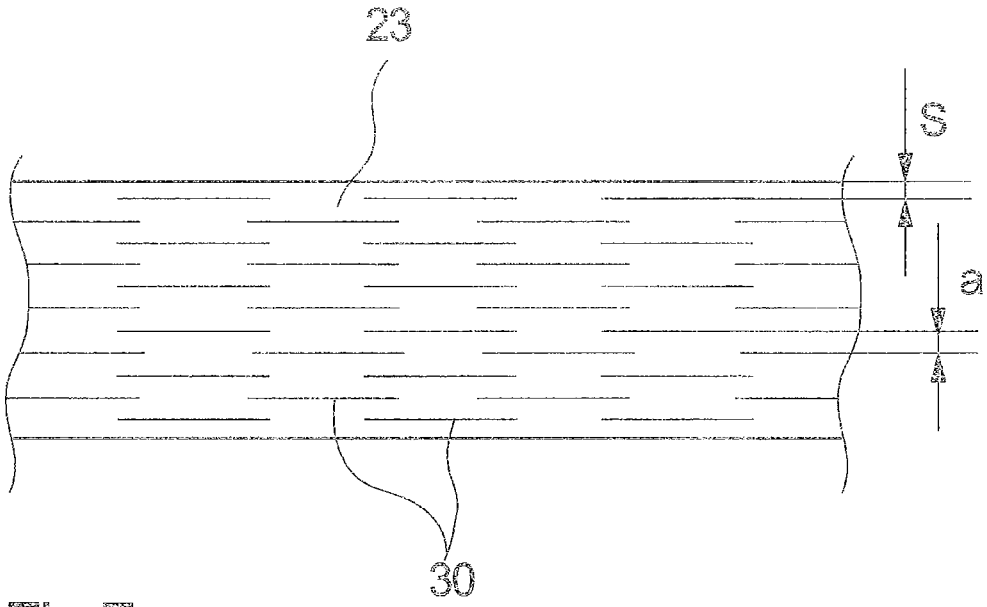
FIG. 7 depicts schematically, a top view of a fibrillated ribbon.

As follows from the depiction provided in FIG. 6, the width of the stretched ribbons 23 narrows from the original cutting width B to a finite width b. In this manner, larger spacings are obtained between adjacent ribbons. In order to symmetrically fibrillate each of the ribbons 23 with a maximal cutting allocation, the ribbons 23 are adjusted via the guide pins 15 in such a manner that at each edge region of the ribbons 23 a minimum spacing between the ribbon edge and the first partial cut is maintained. This minimum spacing is indicated in FIG. 7 with the identifying letter S. FIG. 7 shows a single ribbon 23 with the generated fibrillation pattern.

The displacement set between the cutting tips 29 of the rows of blades 34.1 and 34.2 is indicated in the generated partial cuts of the ribbon 23 with the identifying letter a. In this respect, the partial cuts during fibrillation of the ribbons 23 occur with a spacing a on the ribbons 23. In this manner, it is possible to generate very fine net-shaped fibrillation structures. The ribbon 23 shows a fibrillation pattern 30 in a net-shaped structure, which is generated by continuously repeating partial cuts from offset cutting tips on the fibrillation roller.

For fibrillation, a fibrillation roller 10 is preferably driven with a circumferential speed, which is faster than the feed rate of the ribbons. As a result of the smaller cutting resistances during fibrillation, it is possible to maintain relatively small speed differences between the ribbons and the fibrillation roller. The low cutting resistances during fibrillation are also particularly suited for providing very elastic ribbons and very thick ribbons with a uniform fibrillation structure. As such, in the production of grass yarn in particular, this method has proven itself for the fibrillation of ribbons that are preferably generated by means of co-extrusion, having thicknesses in the range of 150 μm-500 μm. The expansions of the ribbons may have values for this of over 50%. As such, it is possible to securely fibrillate ribbons having an expansion of up to 75% and more.

The method according to the invention and the apparatus according to the invention are suitable for the fibrillation of all conventional ribbons made from thermoplastic materials. In this regard, it is contemplated that the extrusion die 3 in the exemplary example depicted in FIG. 1 can be replaced with a monofilament extrusion tool, such that during the extrusion numerous individual ribbons can be generated. In this case, the cutting device depicted in FIG. 1 is eliminated. In this respect, the method according to the invention and the apparatus according to the invention are also particularly suited for the fibrillation of individually generated ribbons after stretching. In this case, in particular, high frequency rates of the partial cuts in the individual ribbons are possible. By means of adjustment, even small minimum spacings at the edges of the ribbons can be securely set and maintained. In particular, the polymer types PP, LLDPE, HDPE or PA have been shown to be reliable as the materials.

REFERENCE SYMBOL LIST

1 extrusion apparatus
2 extruder
3 extrusion die
4 cooling bath
5 redirection device
6 cutting device
7.1, 7.2 godet delivery device
8 heating device
9 fibrillation device
10 fibrillation roller
11 guide rail
12 crimping device
13 texturing means
14 adjustment device
15 guide pin
16 carrier
17 guide track
18 coiling device
19 coiling station
20.1, 20.2 guide roller
21 guide groove
22 film
23 single ribbon
24 ribbon bundle
25 electric motor
26 control device
27 machine control
28 blade strip
29 cutting tip
30 fibrillation pattern
31 blade
32 contact surface
33 multiple coating
34.1, 34.2 rows of blades

The invention claimed is:

1. A method for the fibrillation of plastic ribbons comprising:

generating ribbons as a ribbon bundle from an extruded film or numerous extruded monofilaments;

collectively stretching the ribbons;

feeding the stretched ribbons in parallel, adjacently, with a partial wrap about the circumference of a fibrillation roller; and, generating a plurality of short partial cuts are on the ribbons by a plurality of successively engaging rows of blades on the fibrillation roller, each row having a plurality of projecting cutting tips with blades, wherein the ribbons are adjusted prior to fibrillation individually in such a manner that the partial cuts are generated such that the cuts are substantially symmetrical on each ribbon and have a minimum spacing to the ribbon edges.

2. The method according to claim 1, wherein at least two groups of short partial cuts are generated on the ribbons by means of offset cutting tips on two successively engaging rows of blades.

3. The method according to claim 1 wherein the fibrillation roller is driven for the generation of the partial cuts on the ribbons with a circumferential speed which is faster than a feed rate of the ribbons.

4. The method according to claim 3, wherein the ribbons are fed with a partial wrapping about the circumference of the fibrillation roller over a friction reducing contact surface between the rows of blades.

5. The method according to claim 1, wherein after the stretching, the ribbons exhibit a thickness in the range of 150 μm-500 μm and or a material expansion in the range of 50%-75%.

6. A fibrillating apparatus comprising:

an extrusion apparatus for generating a ribbon bundle consisting of a plurality of numerous ribbons;

a first godet device upstream and spaced from a second godet device for stretching ribbons of the ribbon bundle; and a fibrillation roller disposed between the first and second godet device wherein the roller includes a plurality of blade strips distributed uniformly on its circumference, with a plurality of projecting cutting tips having blades disposed in rows on each blade strip; and, an adjustment device upstream of the fibrillation roller for adjusting each individual ribbon in relation to the position of the cutting tips for generating partial cuts such that the cuts are substantially symmetrical on each ribbon and have a minimum spacing to the ribbon edges.

7. The apparatus according to claim 6, wherein the cutting tips on adjacent rows of blades are offset in relation to one another.

8. The apparatus according to claim 6, wherein the adjustment device includes displaceable guide pins or guide rollers, disposed between the ribbons.

9. The apparatus according to claim 8, wherein the guide pins or guide rollers can be individually adjusted.

10. The apparatus according to claim 6, further comprising a controllable drive associated with the fibrillation roller and being connected to a machine control unit for setting predetermined circumferential speeds of the fibrillation roller.

11. The apparatus according to claim 6, further comprising a friction reducing contact surface provided on the circumference of the fibrillation roller between adjacent blade strips.

12. The apparatus according to claim 11, wherein the contact surface has a multiple coating formed by a plurality of sandwich-like individual coatings.

13. The apparatus according to claim 12, wherein an outer individual coating of the contact surface is a low-friction material for reducing the friction, and an inner individual coating of the contact surface is a protective material for reducing wear.

14. The apparatus according to claim 13, wherein the protective material is formed from a ceramic material and the low-friction material is formed from a plastic.

15. The apparatus according to claim 6 wherein the adjustment device is located between the first and second godet devices.

16. The apparatus according to claim 15 wherein the adjustment device is located upstream of the fibrillation roller.

* * * * *